United States Patent [19]

Jaidinger et al.

[11] 4,112,400

[45] Sep. 5, 1978

[54] RELAY FOR PRINTED CIRCUITS

[75] Inventors: John H. Jaidinger, Marengo; Mamoru Sakazaki, Chicago, both of Ill.

[73] Assignee: Jaidinger Mfg. Co., Inc., Chicago, Ill.

[21] Appl. No.: 797,693

[22] Filed: May 17, 1977

[51] Int. Cl.[2] ..... H01H 67/02

[52] U.S. Cl. ..... 335/128; 335/135

[58] Field of Search ..... 335/128, 129, 135, 197, 335/198, 202

[56] References Cited

U.S. PATENT DOCUMENTS

| | | | |
|---|---|---|---|
| 3,242,285 | 3/1966 | Obszarny et al. | 335/129 X |
| 3,256,401 | 6/1966 | Dawson | 335/129 |
| 3,800,250 | 3/1974 | Mori et al. | 335/135 X |

*Primary Examiner*—George Harris

*Attorney, Agent, or Firm*—Emrich, Root, O'Keeffe & Lee

[57] ABSTRACT

An electrical relay characterized by a simplified centrally stacked construction of stationary parts, using a minimum of easily fabricated and assembled components, and having an increased capacity for a given sensitivity. The relay can operate on 110 millivolt range and incorporates a pair of identical switch blades which are assembled in fixed, stacked, insulated, reverse relationship on the core under an armature suspended in biased hinged relationship from a yoke. One feature of the invention is the press-fitting of the sandwich of switch blades and insulators on the core in a fixed non-rotational relationship that insures that the spacing and attitude of the contacts remains constant and providing a wiping action at the contacts during operation making the relay suitable for handling heavier currents.

6 Claims, 5 Drawing Figures

RELAY FOR PRINTED CIRCUITS

BACKGROUND OF THE INVENTION

The prior art relays are generally fabricated from multiple small dissimilar parts and are held together by a plurality of rivets which not only lengthen the assembly time and increase the cost, but also are tedious to assemble. Furthermore, the response and adjustment capabilities of prior art relays are minimized and require 400 or more millivolts for proper operation. In some instances the contact mountings are such that the contacts tend to burn and their conductivity, as well as reliability, cannot be maintained at acceptable industrial standards.

SUMMARY OF THE INVENTION

The relay of the instant invention overcomes these and other shortcomings of the prior art by providing inter alia a pair of switch blades that are fabricated in identical form and are assembled directly upon the core in a stacked, insulated, press-fit relationship in one easy operation. To provide the necessary spacial relationship of the contacts with the armature, one switch blade is stacked upside down in relation to the other. The switch blades have off-set, L-shaped, resilient contact arms that are readily adjusted in relation to the armature contacts and move laterally at their contacting surfaces to keep the contacts clean. A press-fit washer at one end of the core and staking at the other end firmly and permanently fasten the assembly together. The switch blades are large enough to be readily assembled by hand and no soldering is necessary to complete the assembly. These and other features of the invention will be described or become apparent as the description proceeds.

DESCRIPTION OF THE DRAWINGS

An illustrative embodiment of the invention is shown in the drawings wherein.

DESCRIPTION OF THE PREFERRED EMBODIMENTS

Figure 1:
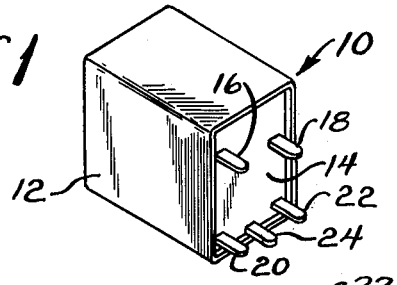
FIG. 1 is a perspective view of a relay constructed in accordance with this invention and shown within its plastic housing.

Referring to FIG. 1 the relay 10 includes the plastic housing 12 that is enclosed on five sides and has the sixth side open to receive the laminated cotton-phenolic insulator 14 having holes to receive the top terminals 16 and 18 and the bottom terminals 20 and 22, as well as the ground 24, which protrude through holes therein and are arranged to be plugged into a circuit board or the like in a manner known to this art.

Figure 2:
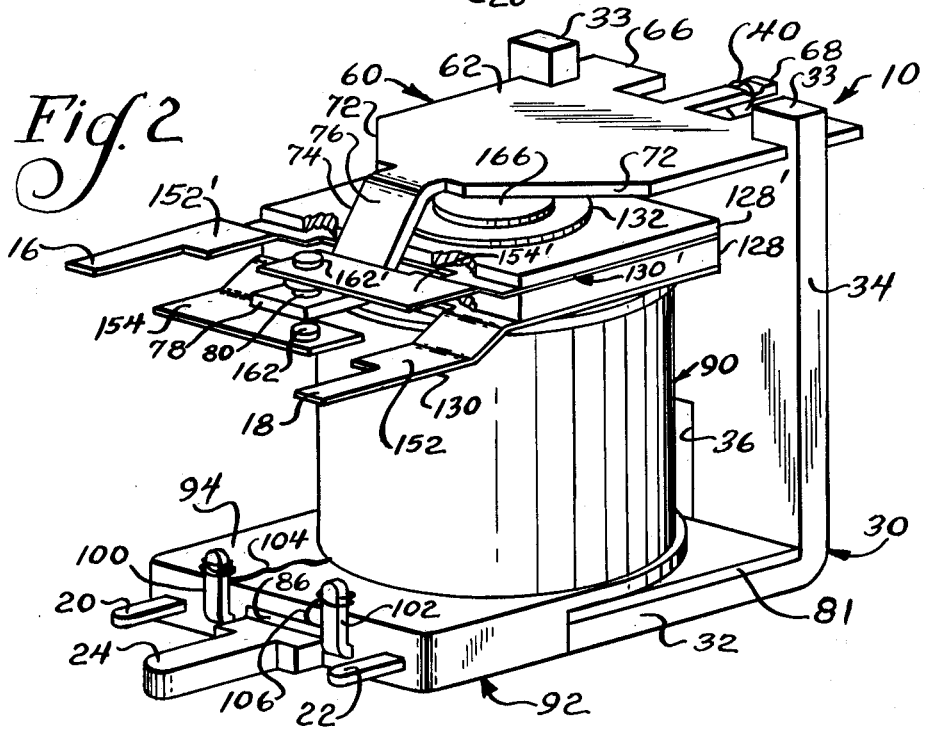
FIG. 2 is an enlarged perspective view of the relay of FIG. 1 removed from the housing.
Figure 3:
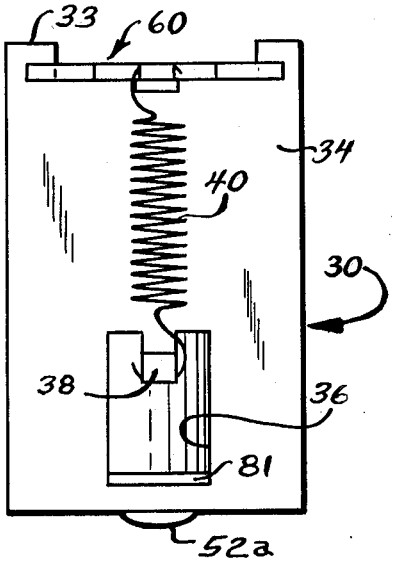
FIG. 3 is a back plan view of the relay to show the spring biasing means.

Referring to FIGS. 2 and 3, the relay 10 is shown to have a stamped metal yoke member 30 with a flat base 32 and an upright support wall 34 that defines the protruding tabs 33 at the corners of its top edge. The cutout 36 in the back wall 34 defines the tab 38 at its top edge to receive the lower end of the spring 40, the function and further connection for which will be described.

Figure 5:
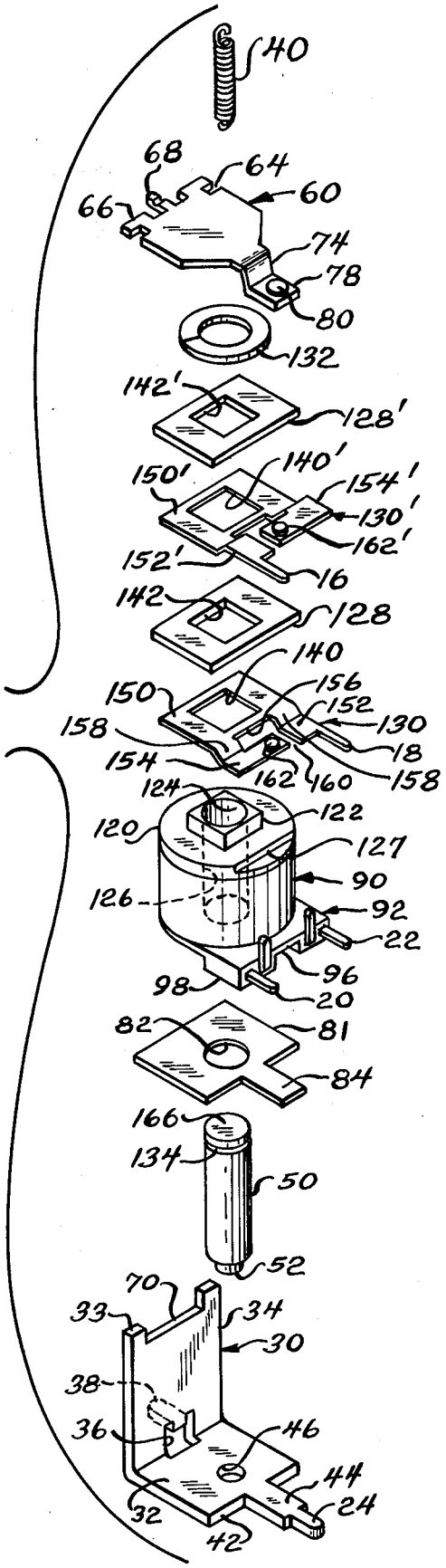
FIG. 5 is an exploded view of the relay to show the individual parts and also illustrate the manner in which the parts would be assembled.

The base 32 of the yoke 30 has the front corners cut out on each side of a center line, as at 42 in FIG. 5, to define therebetween the shank 44 having the smaller ground terminal 24 at its extended end. A central bore hole 46 in the base 32 receives the paramagnetic steel core 50 having a stake end 52 which is peened over as illustrated at **52*a*** in the course of assembly.

The magnetic steel armature 60 has the planar body portion 62 having the opposed outwardly opening square notches 64 (See top of FIG. 5) at the side edges, spaced inwardly from the back edge 66 which is cut out to form the upper tab 68 to which the top end of the coil spring 40 is engaged. Each of the notches 64 is wide enough to encompass the thickness of the upright back wall 34 and thus engage over the upright tabs 33 at the top edge of this wall. The tabs 33 maintain the armature 60 against movement in the plane of the body 62 and the under surface of the body 62 rests upon the top edge 70 (See bottom of FIG. 5, of the yoke 30 in a pivotal, electrical-conducting relationship, being held upwardly by the bias of the spring 40 in its assembled condition. The pivotal action at the juncture of the tabs 33 and the notches 64 is greater than necessary for proper movement of the armature in its intended function so that there is no binding.

The front edge of the armature 60 is uniformly tapered at the opposite edge 72 (FIG. 2) to define the rigid contact arm 74 having the shank portion 76 downwardly off-set from the plane of the body portion 62. The contact arm 74 has the projecting end 78 which bears the silver contact 80 positioned centrally thereof and extending through to both sides of the end 78. The contact 80, as well as the other contacts to be described, can be applied by riveting, staking and welding, as is well known in this art.

Both the yoke member 30 and the armature 60 are copper plated and are essentially rigid structures, although the latter may be formed of thinner sheet stock, as illustrated.

The insulator 81 (FIGS. 2 and 5) is flat and rectangular so as to fit upon and conform with the base plate 32 of the yoke 30 and includes the central bore hole 82, large enough to encompass the core 50. The insulator 81 has the front projection 84 that extends over a portion of the shank 44 to a position near the inner end of the ground terminal 24, as shown by the edge 86, visible in FIG. 2.

Figure 4:
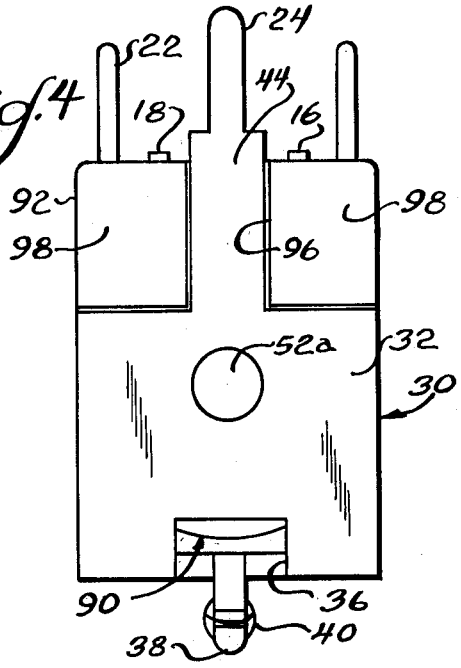
FIG. 4 is a bottom plan view of the relay of FIG. 2.

The operating coil 90 includes the bobbin 92 having a flat base 94 with a rectangular notch 96 on its underside between the defining the bosses 98 that protrude on each side from the bottom surface of the bobbin. These parts are dimensioned so that with the insulator 81 in place on the base 32 the bosses 98 fit within the cut-out corner 42 of the base plate 32 and the insulator 81 with the shanks 44 and 84 extending into the notch 96 as illustrated in FIGS. 2 and 4. This forms a non-rotational sandwich base for the assembly. Also, the combined thicknesses of the base 32 and the insulator 81 are about equal to the height of the bosses 98 so that in the assembled condition the entire bottom of the relay is flat.

The bobbin 92 is preferrably formed of a molded thermoplastic resin having good electrical insulating and molding properties such as nylon or the like. The base 94 includes the printed circuit terminals 20 and 22 which may be molded integrally therein as illustrated so that their core leads or legs 100 and 102 protrude upwardly therefrom to receive the coil lead wires 104 and 106 which can be soldered thereto.

Alternately, the bottom or base 94 of the bobbin 92 can have suitable conforming notches molded therein to receive the printed circuit terminals 20 and properly position these core leads 98 and 100. The coil lead 104 connects to the coil winding on the outside of the coil 90, while the coil lead 106 passes between the bobbin base 94 and the insulator leg 84 to the center of the coil.

The coil 90 contains appropriate windings, as is known in this art, and is covered with a suitable insulating tape or shrink tubing such as spiral wound thermoplastic resin tubing that is stretch oriented and heat shrunk upon the outer surface of the coil proper. For this purpose, spiral wound tubing formed of polyethylene terephthalate, can be used, known in this art by the trademark "Mylar" furnished by DuPont.

The top end 120 of the bobbin 90 forms an insulating cap and includes the square insulating tube or projection 122 above its top surface having a central bore hole 124 which is concentric with the bore hole 126 in the center of the coil 90 and suitable to receive the core 50.

The front or side edge of the top end 120 is provided with a transverse notch 127 to provide clearance for the moving parts, as will be described.

The assembly includes the pair of identical square insulator washers 128 and 128', the former of which is between the identical (but reversed) lower contact arm 130 and upper contact arm 130' and the latter of which is between the upper contact arm 130' and the top retaining split ring washer 132. The core 50 has the circumferential groove 134 spaced from its top end to ultimately receive the non-ferrous, snap-lock washer 132 and hold the assembly together in stacked, non-rotating relationship.

As illustrated, the insulating washers 128 and the contact arms 130 are each flat members and have the respective square holes 140 and 142, which numerals are primed to correspond to these respective parts. The holes 140 and 142 are of such a size and configuration as to fit over and upon the protuberance 122 of the operating coil 90 in a non-rotating, close-fitting, sandwich relationship for these parts.

The contact arms 130 are constructed of flexible sheet metal having good electrical conducting properties, as well as providing the necessary spring action for the intended purpose. The description of one of the contact arms 130 will suffice for both.

Thus, the contact arms 130 has the flat square body portion 150 surrounding its square hole 140 and a pair of contact legs 152 and 154 that extend from the edge 156 in bifurcated, spaced relationship. Each contact leg is off-set downwardly, as at 158, from the plane of the body 150. Accordingly, the legs 152 and 154 are in a plane below the plane of the body portion 150.

The contact leg 152 bears the printed circuit terminal 18 at its end, which protrudes through the insulated cover 14 as shown in FIG. 1.

The other contact leg 154 is L-shaped and extends toward and substantially in the same plane with the contact leg 152, but is spaced therefrom as indicated by the space 160. At the end of the contact leg 154 there is provided the electrical contact 162 that is either riveted, staked or welded therein so as to protrude from both sides of the leg 154.

Since the spring contact arm 130' has the same construction and the corresponding parts bear prime numbers, it is to be noted that in the reverse position of the assembly, the legs 154' and 152' extend upwardly from the flat portion 150'. This provides space for the leg 78 of the armature 60 so that the electrical contact 80 thereof is directly in line with the electrical contacts 162 and 162' in the assembled condition of these parts.

This relationship is better shown in FIG. 2 wherein it is seen that the armature 60 extends over the top of the exposed end 166 of the core 50 in spaced relationship and the contact arm 78 is positioned between the upper contact arm 154' and the lower contact arm 154 so that its electrical contact 80 (which extends through the contact arm 78) is in operable position between the respective electrical contacts 162 (lower) and 162' (upper). A portion of the insulator 128' has been cut away so that more of the upper contact arm 130' is visible.

The spring 40 biases the armature 60 so that the electrical contact 80 of the contact arm 78 is in direct contact with the underside of the electrical contact 162'. The actuation of the coil 90 produces a magnetic field which pulls the armature 60 down and this action breaks the aforesaid direct contact and makes direct contact of the underside of electrical contact 80 with the lower electrical contact 162.

Referring to FIG. 5 the assembly of the relay of this invention may be as follows.

The core 50, through its stake 52, is affixed to the hole 46 of the yoke 30 of means of the stake fastening **52*a*. The insulator 81 is dropped over the core and then the coil 90 is placed thereon with the bosses 98 on each side of the extension 44 of the yoke. At this point the end 166 of the core 50 extends above the square protuberance 122 on the coil sufficiently to receive the washer 132**.

Hence the lower contact arm 130 is dropped onto the square protuberance 122, then a washer 128, followed by the upper contact arm 130' (in reverse or upside down position), then a washer 128' is placed on top of the stack and the assembly is axially affixed by means of the C-washer 132 which can now engage the groove 134. Alternately, at this point in the assembling of the relay, a pair of contact arms 130 and a pair of washers 128 can be pre-stacked and placed on the protuberance 122. This method of handling these parts is facilitated by the fact that the washers 128 fit upon and conform to the flat portions 150 of the contact arms.

Next, the armature 60 is tilted and slipped or dropped into place and the spring 40 attached to complete the basic assembly of FIG. 2.

The last step is to insert the relay 10 into the cover 12 and snap the cover 14 over the contacts 16, 18, 20, etc. A depression can be molded into the bottom (or a side of the cover 12 if it is square) to snap-fit over the staking **52*a* and hold the relay 10 inside the cover 12**.

It is apparent that a number of modifications can be made in the structure of the relay assembly so far described and that the invention relates in one aspect to the mounting of the flexible contact arm members 130 upon the coil member 90 using support means between the coil member and the contact arm members that hold them in insulated, spaced and non-rotative relationship from the axes of the coil member. To accomplish this purpose, any form of cooperating projection and aperture can be used and this interlocking relationship can be accomplished by mating means located at any desired axial position between the parts.

Thus, the projection 122 need not be centrally located and need not be square as disclosed. The projection 122 can be half-round, rectangular, triangular or any irregular shape that will mate with a corresponding aperture in the flexible contact arms and prevent rotation. Also, it is not necessary that the washers 128 include a mating aperture. The washers can be round or any other shape and do not necessarily have to be oriented.

In addition, the projection-aperture relationship of the parts can be reversed. To illustrate, the top 120 can be provided with a shaped depression or slot and the flat bases 150 of the contact arms can include a corresponding protuberance or tab which seats therein to define the mated relationship intended as part of this invention.

It is also apparent that the assembly can include but one contact arm 150 or a plurality of such arms, preferably in matched reversed pairs to accomplish other switching junctions. More particularly, the flexible contacts can also be planar, i.e., with the off-sets 158 omitted and the necessary spacing provided by additional washers 128.

the sandwiched assembly of this invention presents a number of additional advantages. The contact arms 154 are positioned relatively close together on an exposed side of the assembly so that they can be readily reached with a needle-nose pliers and bent upwardly and downwardly to make finite adjustments in the contacting junctions without disrupting their attachment to the coil.

What is claimed is:

1. An electrical relay assembly comprising:

a yoke member;

a coil member and associated axial core member therein;

an armature pivotally supported by said yoke member in operative relationship with said coil member and associated core member;

said armature having a contact arm extending over one side of said coil member;

a pair of flexible contact arm members supported from the axis of said coil member and having their spaced respective contact arms positioned to said side and above and below said contact arm of said armature for makebreak contact therewith; and support means between said coil member and said flexible contact arm members holding said arm members in insulated, spaced and non-rotative relationship from the axis of said coil member.

2. An electrical relay assembly in accordance with claim 1 in which:

said support means includes an off-center insulating protrusion on said coil member; and said flexible contact arm members have a corresponding aperture to receive said protrusion and align said contact arms in said non-rotative make-break relationship with said armature.

3. An electrical relay assembly in accordance with claim 2 in which:

said support means is defined by an out-of-round protrusion extending from said coil member;

said flexible contact arm members each have a flat base portion defining an aperture which mates with said protrusion and said flexible contact arms are thereby axially and vertically oriented in said make-break relationship with said armature.

4. An electrical relay assembly in accordance with claim 3 including:

at least one flat insulating washer having an aperture that encompasses said protrusion of said support means and is positioned between said flexible contact arms.

5. An electrical relay assembly in accordance with claim 1 in which:

said yoke member is L-shaped to include a base wall and a supporting wall;

said armature is pivotally supported from said supporting wall and normally biased away from said core member;

said core member is affixed to said base wall of said yoke member at one end;

said flexible contact arms have apertured body portions that encompass said core member; and means are provided at the other end of said core member to hold said base members in axially-fixed stacked relationship upon said core member.

6. An electrical relay assembly in accordance with claim 1 in which:

said yoke member includes a base wall with a cut-out corner and a central aperture;

said coil member includes a bobbin member with a bottom protuberance;

said core member is adapted to be staked to the central aperture of said base wall; and the bottom protuberance of said bobbin engages said cut-out corner of said base wall in locked relationship.

* * * * *